United States Patent [19]

Moses et al.

[11] 3,969,072

[45] July 13, 1976

[54] PERPHTHALIC ACID AFTER-TREATMENT OF PHOSPHONATE FLAMEPROOFED FABRICS

[75] Inventors: Dudley K. Moses, Wadsworth; George L. Brodmann, Akron, both of Ohio

[73] Assignee: PPG Industries, Inc., Pittsburgh, Pa.

[22] Filed: Aug. 1, 1975

[21] Appl. No.: 600,993

[52] U.S. Cl. ..... 8/111; 8/116 P

[51] Int. Cl.[2] ..... D06L 3/02; D06M 13/32

[58] Field of Search ..... 8/111, 111.5, 116 P

[56] References Cited

UNITED STATES PATENTS

| | | | |
|---|---|---|---|
| 2,273,774 | 2/1942 | Reichert | 8/111.5 |
| 3,639,285 | 2/1972 | Nielsen | 8/111.5 |
| 3,655,738 | 4/1972 | Nielsen | 260/502 |

FOREIGN PATENTS OR APPLICATIONS

| | | | |
|---|---|---|---|
| 550,491 | 1/1943 | United Kingdom | 8/111.5 |

*Primary Examiner*—Donald Levy
*Assistant Examiner*—Maria S. Tungol
*Attorney, Agent, or Firm*—Roger S. Benjamin

[57] ABSTRACT

Perphthalic acid solutions remove discoloration from heat-cured phosphonate-treated fabrics.

8 Claims, No Drawings

PERPHTHALIC ACID AFTER-TREATMENT OF PHOSPHONATE FLAMEPROOFED FABRICS

BACKGROUND OF THE INVENTION

Fibers and fabrics treated with curable phosphonates are rendered flame retardant. The phosphonate flame retardant agents are often fixed to the fabric substrate by heat-curing at temperatures in excess of 120°C., however, heat-cure procedures frequently give rise to discoloration, typically a yellowing of the treated fabric. It is known that after treatment with aqueous solutions of sodium perborate or hydrogen peroxide at temperatures above 70°C. will remove the discoloration.

The Invention

This invention is a process for removing discoloration in heat-cured phosphonate flameproofed substrates by contact with perphthalic acids. This invention is additionally an improved process for flame-proofing fabrics by applying a phosphonate flame-retardant composition, heat-curing the phosphonate composition impregnated fabric, and then removing discoloration in the fabric with perphthalic acid solution.

It has been discovered, in accordance with this invention, that perphthalic acids, notably diperisophthalic acids are effective in removing or substantially reducing discoloration encountered in the heat curing of phosphonate flameproofed fabrics. Treatment with perphthalic acid solutions removes discoloration at concentrations which are a fraction of those recommended for use with sodium perborate or hydrogen peroxide, known agents for removing discoloration. Removal of discoloration with perphthalic acids may be achieved under conditions of low temperature (e.g., room temperature) and mild pH.

Use of perphthalic acids, especially monoperphthalic acid and diperisophthalic acid removes heat-cure phosphonate discoloraton without substantially affecting dye shade or dye strength of colored fabrics. Thus, the process of this invention may be applied to dyed as well as natural or bleached substrates.

The effectiveness of perphthalic acids in removing or reducing heat-cure discoloration of phosphonate treated fabrics permits the use of higher curing temperatures with an attendant lessening of cure time and consequently more rapid fabric processing. In addition, the heat-cure discoloration removal of perphthalic acids encourages the use of phosphonate flame retardant compositions comprising heat sensitive (discoloration producing) comonomers.

In summary, practice of this invention offers advantages of energy saving (low temperature use), faster processing (rapid curing), low decomposition residues (less perphthalic acid required than conventional materials), less substrate damage (low temperatures and mild pH), and applicability to dyed as well as undyed fabrics.

DETAILED DESCRIPTION OF THE INVENTION

Perphthalic Acids

The invention removes heat-cure phosphonate discoloration by use of one or more peroxyphthalic acids, inclusive of the mono- and di-peracids of terephthalic, isophthalic, and phthalic acids. Peracids preferred in the practice of this invention are monoperphthalic acid (see, U.S. Pat. No. 3,510,512 to Jourdan-Laforte, patented May 5, 1970) and diperisophthalic acid (see, U.S. Pat. No. 3,655,738 to Nielsen, patented Apr. 11, 1972) with diperisophthalic acid being especially preferred because of its stability and available oxygen content.

Phosphate Flameproofing Agents

Fibers and fabrics are flameproofed with phosphonate agents, heat cured, and then treated with perphthalic acids to remove or substantially reduce discoloration. The phosphonate flameproofing agents are monomeric or oligomeric precursors of high molecular weight addition-type or condensation-type phosphonate polymers. In addition, these phosphonate polymer precursors may be interpolymerized with other monomers or polymers to impart desirable properties such as improved finish or flexibility.

Illustrative of phosphonate flameproofing agents are vinyl phosphonates, such as described in U.S. Pat. No. 3,695,925 and the primary polyol phosphonates such as described in U.S. Pat. No. 3,746,572. Other useful phosphonates include copolycondensed vinyl phosphonates prepared by the co-condensation of a (2-haloalkyl) vinyl phosphonate or an alpha-methylvinylphosphonate and its halohalide adduct precursor; allyl-2-carbamoylalkylphosphonates; and bis(hydrocarbyl) vinyl phosphonates. If desired, the phosphonate flameproofing agent may be copolymerized with monomers containing no phosphorus. For example, vinyl phosphonates may be copolymerized with nitrogen containing derivatives of acrylic or methacrylic acid, such as methylolacrylamide.

Heat Curing

The phosphonate treated fibers and fabrics are efficiently and easily cured by heating at temperatures in a range of from about 120° to about 180°C. At the higher end of the temperature range (above 149°C.) the phosphonate precursors may be cured in a matter of seconds or minutes, which provides convenience for the rapid continuous commercial fabric finishing. To assist the heat curing procedure a catalyst may be added to the phosphonate flameproofing agent applied to the fabric. For example, a free-radical catalyst such as sodium persulfate may be used with phosphonates capable of forming addition-type polymers (e.g., vinyl phosphonates). In the case of condensation type phosphonate polymer precursors an acid type catalyst such as succinic acid may be used.

The thermal energy may be applied to the fabric as radiant energy (infrared) or by a current of hot gas, such as hot air or steam. Curing is shortened by using higher curing temperatures. Cure times for heat curing by the practice of this invention are 10 seconds to 30 minutes and typically, 1 minute to 5 minutes.

Substrate

Heat-curable phosphonate flameproofing agents and the discoloration removing perphthalic acid aftertreatment solution may be applied to substrates such as fibers, yarns, filaments; composite structures such as mats; or knitted or woven fabrics. The substrate composition may be natural, synthetic or blends of natural and synthetic materials (e.g., cotton/polyester fabric). The process of this invention is particularly applicable to cellulosic materials such as paper, cotton, rayon, etc.

Perphthalic Acid Treatment

Perphthalic acid solutions may be applied to phosphonate flameproofed substrates by any conventional means such as spraying, dipping, brushing, or padding. It is most desirable and economical to dissolve the perphthalic acid in water and apply the aqueous solution directly to the substrate. Organic solvents (e.g., acetone, isopropanol, t-butanol) which are substantially unreactive with perphthalic acids under selected conditions (viz., lower temperatures) may be used as a vehicle for application.

The perphthalic acid aftertreatment may be conducted over a wide range of temperatures, generally in the range of 15° to 90°C. and preferably between 20° to 68°C. The effectiveness of perphthalic acids in removing discoloration at about room temperature (about 25°C.) is especially advantageous. Perphthalic acids, especially diperisophthalic acid, are used over a wide range of pH within the extremes of very acid and very alkaline conditions. Thus, perphthalic acids such as diperiosphthalic acid have utility at pH values between about 3 and 9, and most preferably between 4 and 8. These mild pH conditions reduce degradation in certain fabrics such as cotton.

The time of perphthalic acid treatment may vary from seconds to hours, although it is generally convenient to operate with contact times between 10 seconds and 30 minutes. The selection of treatment time will depend on factors such as treatment temperature and perphthalic acid concentration.

Generally, the perphthalic acids are useful at concentrations ranging from about 0.01 percent upwards to the solubility limit of the peracid, but typically in the range of 0.05 percent to 0.75 weight percent. The perphthalic acids may be used along or in combination with other inert ingredients. For example, diperisophthalic acid may be used in a form where it is encapsulated with hydrated inorganic salts to prevent its premature decomposition (see U.S. Pat. No. 3,655,738). After the perphthalic acid treatment the phosphonate flameproofed fabric may be washed and dried or dried directly. The small quantities of perphthalic acid decomposition products deposited on the fabric are not deleterious to its eventual use.

Flameproofing with phosphonates may be accomplished by various procedures. An illustration of a suitable process is as follows:

Cotton flannel fabric is padded with a flameproofing composition containing 22% by weight vinyl phosphonate oligomer, 3.6% by weight of methylolacrylamide, 1.25% sodium persulfate, minor amounts of softening agents and chelating agents, and the balance water. The wet pickup from the padder is adjusted to 80% of the weight of the fabric. The flannel is then cured in a forced air oven at 165°C. for 6 minutes. Thereafter, the heat cured phosphonate treated flannel is dipped into a 0.25 percent by weight solution of diperiosphthalic acid at 25°C. for 8 minutes. The flameproofed flannel is dried and stored.

The following Examples illustrate the manner in which this invention may be practiced. All given percentages are based on weight.

Sample Preparation

100% Cotton flannel fabric was used in the following Example. Phosphonate flameproofing agent was applied by a single-dip, single-nip pad applicator to obtain 100 percent wet pickup based on the weight of fabric.

The solution had the following compositions:

| Ingredient | Weight Percent |
|---|---|
| Fyrol 76[1] | 32.00 |
| Sodium Persulfate | 1.5 |
| Water | balance to 100% |

[1]an oligomeric (D.P~5) vinyl phosphonate represented by the formula:

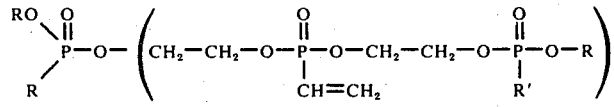

The padded samples cured at 300°F. for 5 minutes in a forced air oven. A yellow-discoloration relative to the untreated fabric was observed. Blue light reflectance of the heat-cured phosphonate flameproofed cotton fabric was approximately 75%.

EXAMPLE 1

The heat-cured phosphonate treated fabrics prepared according to the preceding section were aftertreated with perphthalic acid as shown in the Table below:

Table

| Sample | Temp. | Treatment | Time, min. | Increase in Reflectance[1] After Perphthalic Acid Treatment |
|---|---|---|---|---|
| A | 25°C. | 0.125% DPI[2] | 5 | 5.5 |
| B | 160°F. | 0.125% DPI | 5 | 4.9 |
| C | 160°F. | 0.250% DPI | 5 | 8.6 |
| D | 25°C. | 0.125% DPI | 10 | 12.6 |
| E[4] | 160°F. | 4% $H_2O_2$[3] | 5 | 4.4 |
| F[5] | 180°F. | 1% Sodium Perborate | 5 | 4.0 |
| G | 25°C. | 4% $H_2O_2$ | 10 | 1.55 |
| H | 25°C. | 2% Sodium | 10 | 1.2 |

Table-continued

| Sample | Temp. | Treatment | Time, min. | Increase in Reflectance[1] After Perphthalic Acid Treatment |
|---|---|---|---|---|
| | | Perborate | | |

[1]Hunter Reflectometer, Model D-40, Blue Filter
[2]DPI was used in the form of diperisophthalic acid encapsulated with hydrated $MgSO_4$ in a weight proportion of 75 percent $MgSO_4$ + 25 percent DPI.
[3]$H_2O_2$ concentration is 35 percent.
[4]pH adjusted to 11
[5]pH adjusted to 11

The foregoing data show that perphthalic acids are effective at removing discoloration from heat-cured phosphonate flameproofed fabrics at lower temperatures and lower concentrations than conventional discoloration agents.

While the present invention has been described with respect to certain details of specific embodiments, it is not intended that the invention be construed as limited to such details except insofar as they are set forth in the appended claims.

We claim:

1. A method for removing discoloration from heat-cured phosphonate flameproofed substrate by contacting the substrate with a solution of perphthalic acid.

2. The method of claim 1 wherein the perphthalic acid is monoperphthalic acid and/or diperisophthalic acid.

3. The method of claim 2 wherein the perphthalic acid is diperisophthalic acid.

4. The method of claim 1 wherein the solution of perphthalic acid is aqueous and has a pH between 3 and 9.

5. The method of claim 1 where the substrate comprises cotton.

6. The method of claim 1 wherein the phosphonate is a heat-curable vinyl phosphonate monomer or oligomer.

7. The method of claim 1 wherein the solution of perphthalic acid is contacted with the substrate at a temperature of 15° to 90°C. for a time between 10 seconds and 30 minutes.

8. The method of claim 7 wherein the temperature is between 20° and 68°C.

* * * * *